US009635989B2

(12) United States Patent
Mantel et al.

(10) Patent No.: US 9,635,989 B2
(45) Date of Patent: May 2, 2017

(54) WATER CLOSET

(71) Applicant: Duravit Aktiengesellschaft, Hornberg (DE)

(72) Inventors: Ralf Mantel, Hausach (DE); Winfried Schnell, Mühlenbach (DE)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 0 days.

(21) Appl. No.: 14/971,774

(22) Filed: Dec. 16, 2015

(65) Prior Publication Data

US 2016/0174783 A1 Jun. 23, 2016

(30) Foreign Application Priority Data

Dec. 23, 2014 (DE) ..... 10 2014 119 493

(51) Int. Cl.
*A61G 9/00* (2006.01)
*A47K 13/26* (2006.01)
*E03D 9/08* (2006.01)

(52) U.S. Cl.
CPC ..... *A47K 13/26* (2013.01); *E03D 9/08* (2013.01)

(58) Field of Classification Search
CPC ..... A61G 9/003
USPC ..... 4/450–458
See application file for complete search history.

(56) References Cited

U.S. PATENT DOCUMENTS 5,943,707 A 8/1999 Bergenwall
6,178,568 B1 1/2001 Boulieris
6,381,762 B1 * 5/2002 Moser ..... A47K 13/12 16/252
9,095,241 B1 * 8/2015 Abbuhl ..... A47K 13/12
2002/0035749 A1 * 3/2002 Prisco ..... E03D 9/05 4/213
2008/0271230 A1 * 11/2008 Laundre ..... A47K 13/26 4/236
2010/0146688 A1 * 6/2010 Fielding, Jr. ..... A47K 13/26 4/237
2014/0101832 A1 * 4/2014 Wagner ..... A47K 13/005 4/239

FOREIGN PATENT DOCUMENTS

DE 1443152 A2 8/2004
DE 212012000052 U1 9/2013
DE 202013001133 U1 3/2014
JP 59-14883 1/1984

OTHER PUBLICATIONS

European Search Report from corresponding EP Application No. EP 15 19 5536.6; (8 pages) dated May 24, 2016.

* cited by examiner

*Primary Examiner* — Lori Baker
(74) *Attorney, Agent, or Firm* — Lucas & Mercanti, LLP

(57) ABSTRACT

A water closet comprising a toilet seat set with a lid element and a seat element, a toilet bowl, a douche device with a housing, wherein a mounting plate detachably mountable on the toilet bowl is provided, and in that either at least one fastening element, by which the housing of the douche device can be fastened to the mounting plate and to which the toilet seat set can be fastened, is provided, or at least one first and one second fastening element are provided, wherein the housing of the douche device can be fastened to the mounting plate by the first fastening element and the toilet seat set can be fastened to the mounting plate by the second fastening element.

15 Claims, 5 Drawing Sheets

WATER CLOSET

CROSS-REFERENCE TO RELATED APPLICATIONS

The present application claims priority of DE 10 2014 119 493.4, filed Dec. 23, 2014, the priority of this application is hereby claimed and this application is incorporated herein by reference.

BACKGROUND OF THE INVENTION

The invention pertains to a water closet comprising a toilet seat set with a lid element and a seat element, a toilet bowl, and a douche device with a housing.

Water closets with an integrated or built-in douche device are becoming ever more popular. They make it possible to clean with water, which is effective and also advantageous from a hygienic standpoint, but also gives a pleasant feeling. In the known water closets, the water is supplied to the douche device through a water line connector and a downstream valve, wherein the douche device, usually a douche bar, enters the toilet bowl from the rear. When needed, the douche bar is moved into the toilet bowl by means of, for example, an appropriate electrically motorized drive. To bring the water, which is usually taken from a cold-water delivery pipe, up to a pleasant temperature, a flow-through heater is usually integrated into the douche device. Tank heaters are also known; that is, a water reservoir in the form of a tank is provided, which includes an integrated heating device; the heated water is then drawn or pumped from the tank.

The douche device and the toilet seat set are mounted on the toilet bowl. This mounting makes it difficult to maintain an attractive visual appearance of the toilet after the housing of the douche device and the toilet seat set have been mounted. It is desirable in particular that neither cables nor water lines be visible.

SUMMARY OF THE INVENTION

The invention is therefore based on the goal of providing a water closet of the type indicated above which makes it possible to mount the housing of the douche device and the toilet seat set on the toilet bowl easily while guaranteeing an attractive appearance at the same time.

To achieve this goal, it is provided according to the invention for a water closet of the type indicated above that a mounting plate is provided, which is detachably fastened to the toilet bowl, and that either at least one fastening element, by means of which the housing of the douche device can be fastened to the mounting plate and to which the toilet seat set can be fastened, is provided, or that at least one first fastening element and at least one second fastening element are provided, wherein the housing of the douche device can be fastened to the mounting plate by means of the first fastening element, and the toilet seat set can be fastened to the mounting plate by means the second fastening element.

According to the invention, the water closet is characterized in that at least one fastening element is provided, by means of which the housing of the douche device can be fastened to the mounting plate and to which the toilet seat set can be fastened. The concrete embodiment which is preferred is one in which the housing of the douche device and the toilet seat set can both be fastened to the same fastening element, which therefore means that the at least one fastening element fulfills both fastening functions, namely, the fastening of the toilet seat set and the fastening of the housing of the douche device to the mounting plate and thus to the toilet bowl. It is also possible for at least one first and one second fastening element to be provided, wherein the housing of the douche device can be fastened to the first fastening element and the toilet seat set to the second fastening element.

It is especially preferable for two fastening elements or two first and two second fastening elements to be provided on the water closet according to the invention. The use of two fastening elements or two first and two second fastening elements guarantees an improved mounting of the toilet seat set and of the housing of the douche device, because in this way it is possible for the fastening elements to be arranged with an offset from each other, which results in a greater stability of the mounting.

The one fastening element or the at least one first and second fastening elements preferably include an external thread at one end, which is designed to be screwed into at least one internally threaded opening in the mounting plate. As a result, the fastening element or the at least one first and one second fastening elements can be screwed into the mounting plate, i.e., into the opening or openings with the mating internal threads provided in them.

The housing of the douche device is fastened to the mounting plate by screwing the at least one fastening element or the at least one first fastening element into the opening or openings in the mounting plate. The housing of the douche device, furthermore, includes at least one opening, the diameter of which is larger than the external thread of the fastening element or of the first fastening element. The diameter of the fastening element is larger than that of the external thread of the fastening element and is also larger than the opening in the housing of the douche device. To mount the housing, the fastening element in question or the first fastening element in question is guided through the corresponding opening in the housing and then into the opening in the mounting plate; it can then be fastened, preferably by screwing it in. Another type of fastening is also possible here, namely, a latching, clamping, or snap-in type of connection or some other type known from the prior art. Thus the housing of the douche device can be easily fastened to the mounting plate and thus to the toilet bowl by means of the at least one fastening element or the at least one first fastening element.

The water closet according to the invention can be elaborated in such a way that the mounting plate includes at least one mounting opening to accept a mounting screw for fastening the mounting plate to the toilet bowl. The mounting plate includes for this purpose at least one mounting opening, preferably two mounting openings, each of which accepts one of the mounting screws. The mounting openings in the mounting plate are arranged so that they are coaxial to openings in the toilet bowl when the mounting plate is in position to be fastened to the toilet bowl. The mounting screws, when in the installed state, are secured on the toilet bowl by appropriate means in the form of pins or nuts, which hold the mounting screws and thus the mounting plate in position on the toilet bowl.

The mounting openings in the mounting plate can be just big enough that the mounting screws being used fit exactly, or there can be a certain amount of play between the mounting screws and the mounting plate, so that the position of the mounting plate on the toilet bowl can be adjusted.

An elaboration of the water closet according to the invention can consist in that the toilet seat set includes a connecting element, by means of which the toilet seat set can be fastened to the fastening element by means of a latching, clamping, or snap-in type of connection. It is especially preferable, in the assembled state, for the at least one fastening element or the at least one second fastening element to be screwed into the mounting plate. By means of the connecting element of the toilet seat set, the toilet seat set is thus fastened by a latching, clamping, or snap-in type of connection to the mounting plate, i.e., to the fastening element or elements or to the second fastening element or elements and thus to the toilet bowl.

To improve the latching, clamping, or snap-in connection of the toilet seat set or of the connecting element of the toilet seat set to the mounting plate, it is provided that the free end, i.e., the end opposite the threaded end, of the at least one fastening element or of the at least one second fastening element includes a recess in its cross section, and the toilet seat set includes at least one connecting element complementary to the recess in the cross section. Thus the latching, clamping, or snap-in connection, by means of which the toilet seat set is fastened to the mounting plate is made possible by the engagement of the complementary connecting element in the recess in the at least one fastening element or in the at least one second fastening element. The connecting element of the toilet seat set can be a spring-loaded connecting element or a connecting element which makes possible a latching or clamping or snap-in connection on the basis of its intrinsic deformability and/or a connecting element made out of the material of the toilet seat set, especially plastic. It is also possible to secure the toilet seat set by means of a screw.

The toilet seat set can therefore be fastened to the mounting plate in such a way that the at least one fastening element or the at least one second fastening element can be installed with its free end in the complementary connecting element of the toilet seat set and detachably latch with, clamp on, or snap into the complementary connecting element there.

In a preferred elaboration of the invention, at least one washer is provided to mount the toilet seat set and/or the housing of the douche device. A washer can thus be provided between the housing of the douche device and the fastening element or each of the fastening elements.

To mount the housing of the douche device on the mounting plate, it is provided in a preferred embodiment that the mounting plate includes at least one projection, and the housing of the douche device includes at least one complementary recess or vice versa, and that, after the housing has been mounted, the projection engages in the recess.

The housing of the douche device is thus mounted by way of the projection, which engages in the recess in the mounting plate or vice versa, and it is also fastened to the mounting plate by means of the at least one fastening element or the at least one first fastening element. The projection or the recess into which the projection engages in the assembled state is preferably located on the side of the mounting plate or of the housing of the douche device facing the rear of the water closet; in the installed state of the water closet, this is therefore the side which faces the wall. As a result of the engagement of the projection in the recess, installation is comparatively easy, because the housing of the douche device can be pushed onto the mounting plate and then can be screwed down tight onto the mounting plate by means of the at least one or the at least one first fastening element.

The housing of the douche device preferably includes an electrical line connector and a water line connector on the bottom. Through these connectors, the douche device is supplied with water and electrical current, so that the douche device can be operated. The electrical connector is used here to provide power to an electric motor, for example, which drives the douche bar; to a pump for the douche water; or to a heating device for heating the water. Because the connectors for water and electric current are arranged on the bottom of the housing of the douche device, it is ensured, after the housing of the douche device has been mounted on the toilet bowl or on the mounting plate, that no lines are visible anywhere on the water closet, because these lines, which pass through the interior of the toilet bowl and proceed through at least one opening in the top of the toilet bowl, are connected inside the housing or to the bottom. This ensures an attractive visual appearance, because no cables or hoses can be seen.

To guarantee this visual appearance, it is also be provided that the toilet bowl has an opening for an electrical line and an opening for a water line. These openings are preferably positioned underneath the connectors for the water line and the electrical line on the bottom of the housing, so that, after the housing has been mounted, the water and electrical lines can be connected to the connectors provided on the bottom of the housing. The openings in the toilet bowl are thus provided on the top of the toilet bowl. The mounting plate, furthermore, can include a receptacle for the water line and another for the electrical line, to which these can be attached at least temporarily. Retaining plates can also be provided; each plate includes an opening for the water or electrical or line, which is pushed sideways into the opening and thus held in place. After the lines have been attached, these retaining plates can be removed again, and the lines can then be pushed back into the toilet bowl. For installation, the lines can thus be pulled a certain distance out of the toilet bowl so that they can be attached to the complementary connectors on the bottom of the housing of the douche device. After they have been fastened to the bottom of the housing, they can be pushed back into the toilet bowl. This results in an attractive appearance, because no hoses or electrical lines can be seen after the housing of the douche device has been put in place.

To install the toilet, therefore, the mounting plate is first loosely attached to the toilet bowl by means of at least one mounting screw passing through the at least one mounting opening. Then the externally threaded end of at the least one fastening element or of the at least one second fastening element is screwed into the corresponding opening in the mounting plate. Next, the toilet seat set can be pushed onto the fastening element or elements, which can be configured as pins, for example, and latched, clamped, or snapped in place.

After that, the toilet seat set can be adjusted or aligned on the mounting plate fastened to the toilet bowl by the at least one mounting screw. Once the toilet seat set and thus the mounting plate have been correctly positioned, the mounting plate is fastened by means of the mounting screw. Then the toilet seat set is removed from the at least one or the at least one second fastening element by disengaging the clamping, latching, or snap-in connection. For this purpose, an actuating element, for example, can be provided, which is configured to disengage the latching, clamping, or snap-in connection. The at least one or the at least one second fastening element is then removed also.

In the next step, the electrical line connector and the water line connector are attached to the bottom of the housing of the douche device. After that, the housing of the douche device is pushed onto the at least one projection of the mounting plate, wherein the projection engages in the recess provided for it. In the following step, the at least one fastening element or the at least one first fastening element is screwed into the opening in the housing of the douche device, which is coaxial to the at least one opening in the mounting plate, and then screwed into the mounting plate, preferably with the help of at least one washer. In addition, the at least one second fastening element, if necessary, can also be screwed in. Then the toilet seat set is pushed back onto the at least one or the at least one second fastening element and fastened by means of a latching, snap-in, or clamping connection.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
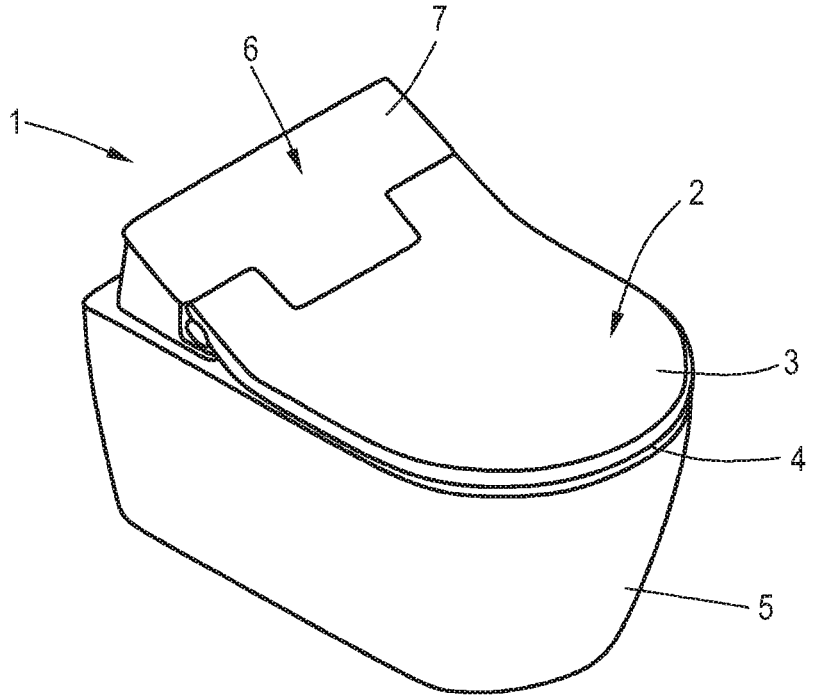
FIG. 1 shows a perspective view of a water closet according to the invention.

FIG. 1 shows a perspective view of a water closet 1 comprising a toilet seat set 2 consisting of a lid element 3 and a seat element 4. The lid element 3 and seat element 4 together form the toilet seat set 2, wherein the lid element and seat element 4 are supported so that they can rotate relative to each other. The water closet 1 also includes a toilet bowl 5 and a douche device 6 with a housing 7.

FIG. 1 shows the water closet 1 in the completely assembled state, in which the housing 7 of the douche device 6 and the toilet seat set 2 are mounted on the toilet bowl 5.

Figure 2:
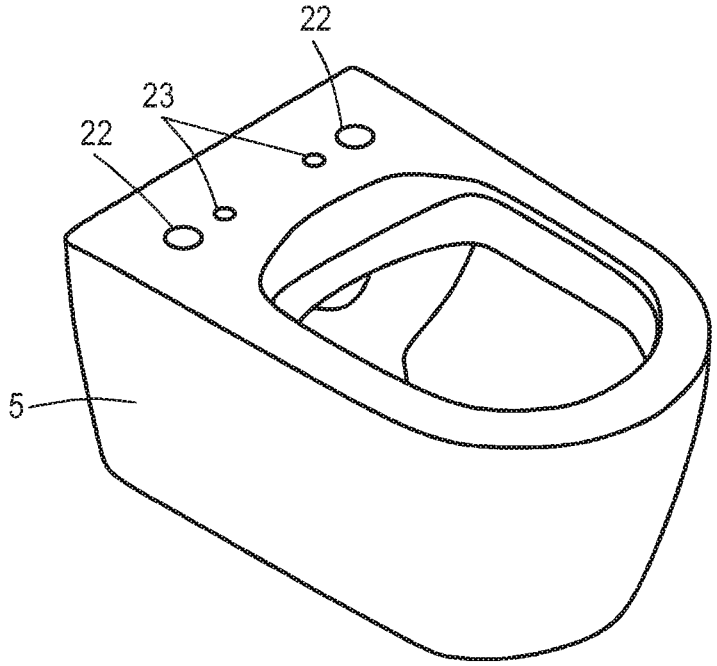
FIG. 2 shows a toilet bowl of the water closet according to the invention of FIG. 1.

FIG. 2 shows a perspective view of the toilet bowl 5 of the water closet 1 of FIG. 1, wherein all of the add-on parts such as the toilet seat set 2 and the douche device 6 have been removed. On the top of the toilet bowl 5, two openings 22 are shown, one of which is provided to accept a water line connector 17, the other an electrical line connector 16. FIG. 2 also shows two openings 23, which are on the inside with respect to the openings 22 and into each of which a mounting screw 9 can engage to fasten the mounting plate 8 to the toilet bowl 5. This is shown in detail in FIG. 3.

Figure 3:
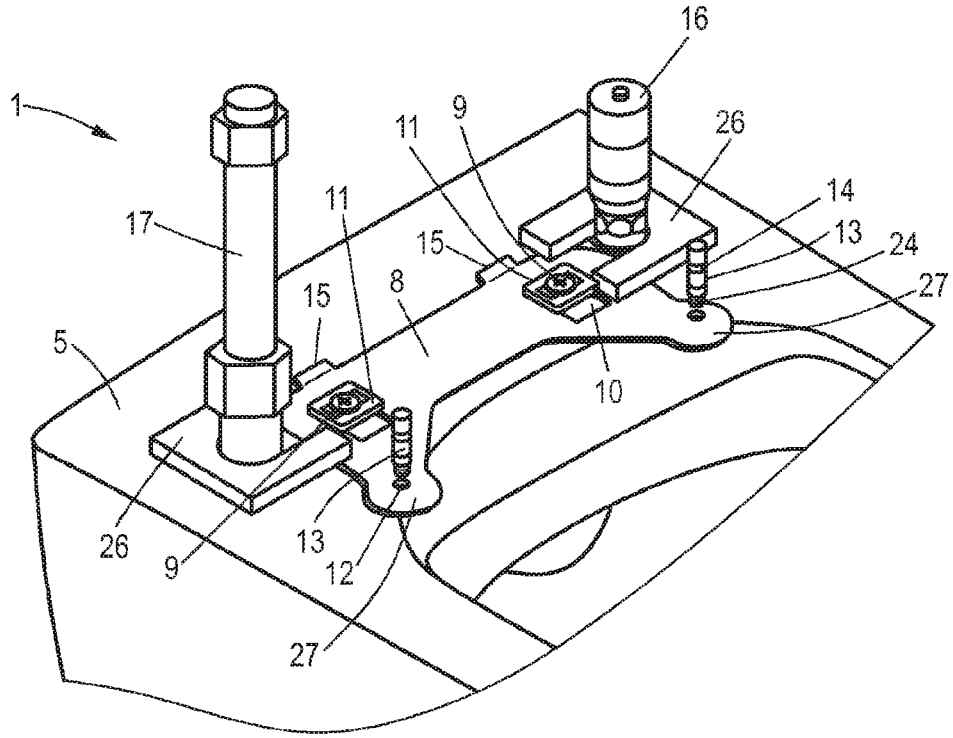
FIG. 3 shows part of the water closet according to the invention of FIG. 1 without the toilet seat set or the housing of the douche device.

FIG. 3 shows a perspective view of the water closet 1 of FIG. 1, before the housing 7 and the toilet seat set 2 are installed. In FIG. 3, a mounting plate 8 is shown, which is fastened to the toilet bowl 5 by mounting screws 9. The mounting screws 9 pass through mounting openings 10 in the mounting plate 8 and into the openings 23 in the top of the toilet bowl 5. There, the mounting screws 9 can be fastened by means of pins or nuts. Support spacers 11 are also provided, which are arranged to extend over the mounting openings 10. By means of the support spacers 11, the mounting plate 8 can be adjusted within a certain range relative to the mounting openings 10.

FIG. 3 also shows that the mounting plate 8 includes two openings 12, each of which is configured to accept a fastening element 13. The openings 12 are also internally threaded, whereas the fastening elements 13 include an external thread 24 at the appropriate end.

At their free end, i.e., the end opposite the external thread 24, the fastening elements 13 include a recess 14, which serves to mount the toilet seat set 2, which will be discussed again further below.

The mounting plate 8 also includes two projections 15, which serve to mount the housing 7 of the douche device 6, which will be described in conjunction with FIG. 4. In addition, an electrical line connector 16 and a water line connector 17 are arranged on the toilet bowl 5. The electrical line connector 16 and the water line connector 17 pass through their assigned openings 22 in the toilet bowl 5, shown in greater detail in FIG. 2, and are guided through these openings 22 to the rear wall of the toilet bowl 5, so that, in the installed state of the water closet 1, no cables or lines can be seen. FIG. 3 also shows retaining plates 26, each of which includes an opening, which partially surrounds its assigned line connector 16, 17. The retaining plates 26 prevent the line connectors 16, 17 from sliding out through the openings 22 into the toilet bowl 5 during assembly. After the line connectors 16, 17 have been attached to the bottom of the housing 7, the retaining plates 26 can be pulled off to one side, and the cable or line connectors 16, 17 are then pushed back as appropriate into the toilet bowl.

Figure 4:
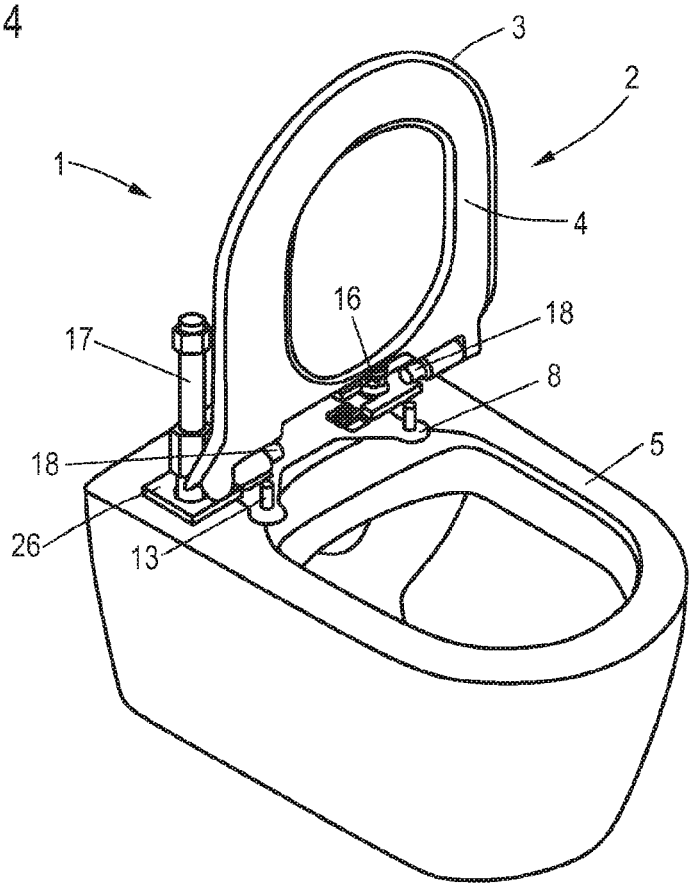
FIG. 4 shows the water closet according to the invention of FIG. 1 during the installation of the toilet seat set.

FIG. 4 shows the water closet 1 of FIG. 1 during the mounting of the toilet seat set 2, i.e., prior to the adjustment of the mounting plate 8. For this purpose, the toilet seat set 2 includes two second connecting means 18, which include a geometry complementary to the recesses 14 in the fastening elements 13 and which therefore make it possible for the toilet seat set 2 to lock onto the fastening elements 13, i.e., to the mounting plate 8 and thus to the toilet bowl 5. The toilet seat set 2 is latched by means of the two connecting means 18, which preferably [illegible] the shafts of the rotational axis of the toilet seat set 2, i.e., of the support of the lid element 3 on the seat element 4.

The toilet seat set 2 with its connecting means 18 is latched in place by setting it down from above onto the fastening elements 13. For this purpose, the fastening elements 13 are introduced into the connecting means 18, and an edge (not shown) provided in the connecting means 18, for example, is brought into engagement with the recess 14, which produces the desired latching effect. For this purpose, the connecting means 18 are configured as an opening, into which the edge projects laterally. The edge includes a shape complementary to the recess 14 and, when engaged in the recess 14, it prevents the fastening element 13 from being pulled out of the corresponding connecting means 18. The edge, furthermore, is connected to an actuating element in such a way that, when the actuating element is actuated, the edge is pushed sideways out of the opening in the connecting means 18. The edge can, for example, be configured as a through-opening in a spring-loaded piece of sheet metal connected to the actuating element. The through-opening includes a diameter which is larger than that of the actuating element 13. When the actuating element is actuated, the opening is moved coaxially to the opening in the connecting element. As a result, the latching connection is disengaged, and the toilet seat set can be pulled away from the fastening element 13 or from the fastening elements 13. As long as the actuating element remains unactuated, the edge remains latched in the recess 14 under spring tension.

Then, after the toilet seat set has been set in place, the toilet seat set 2 and the mounting plate 8 attached to it can be adjusted on the toilet bowl 5, and after the adjustment has been completed, it can be secured by means of the mounting screws 9. After the adjustment, the toilet seat set 2 can be removed again by disengaging the connection between the connecting means 18 and the fastening elements 13. This is achieved, according to this exemplary embodiment, by means of the actuating element, which disengages the edge from the recess 14. It is also possible to overcome the latching resistance by applying a certain force and pulling the toilet seat set 2 from the fastening elements 13. The fastening elements 13, furthermore, can also be removed again, so that the housing 7 of the douche device 6 can be mounted on the toilet bowl 5.

Figure 5:
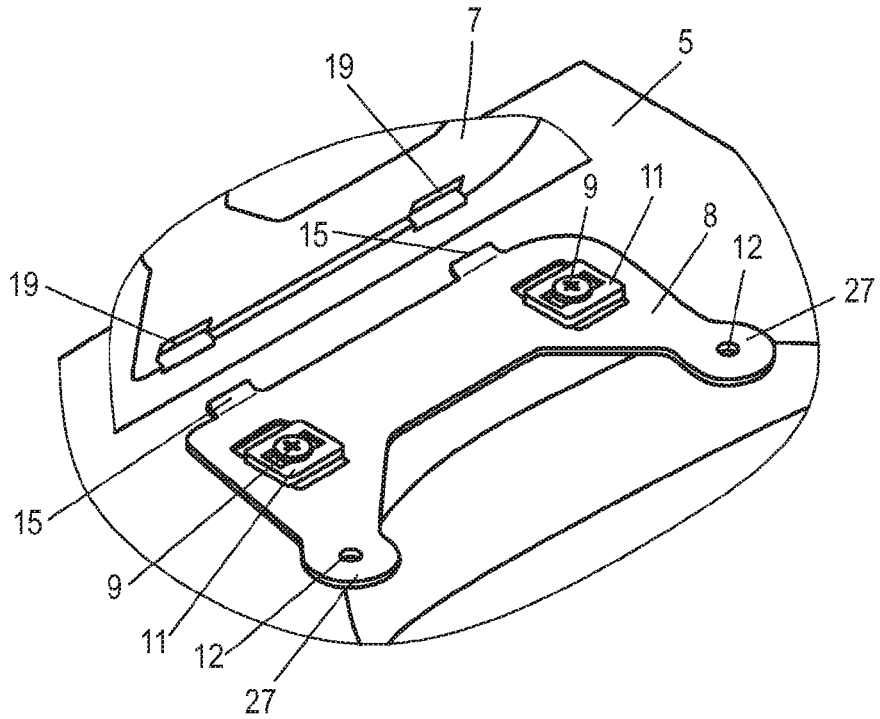
FIG. 5 shows a detailed view of part of the water closet according to the invention of FIG. 1 during the installation of a housing of a douche device.

FIG. 5 shows a detailed view of part of the water closet 1 of FIG. 1 in the area of the mounting plate 8 during the mounting of the housing 7 of the douche device 6. To simplify the drawings, the water line connector 17 and the electrical line connector 16 are not illustrated, and only part of the housing 7 and toilet bowl 5 are shown. FIG. 5 shows the situation which is present when the housing 7, with the recesses 19 complementary to the projections 15 of the mounting plate 8, is being mounted on the mounting plate 8 by pushing it on, for example. In the assembled state, the projections 15 engage in the recesses 19 and thus hold the housing 7 of the douche device 6 in place on the mounting plate 8, which in turn is mounted on the toilet bowl 5. Of course, it is also possible that the projections could be executed on the housing 7 and the recesses on the mounting plate 8.

The mounting plate 8 includes tabs 27, one of which surrounds each of the openings 12; these tabs can have any other desired shape, however.

Figure 6:
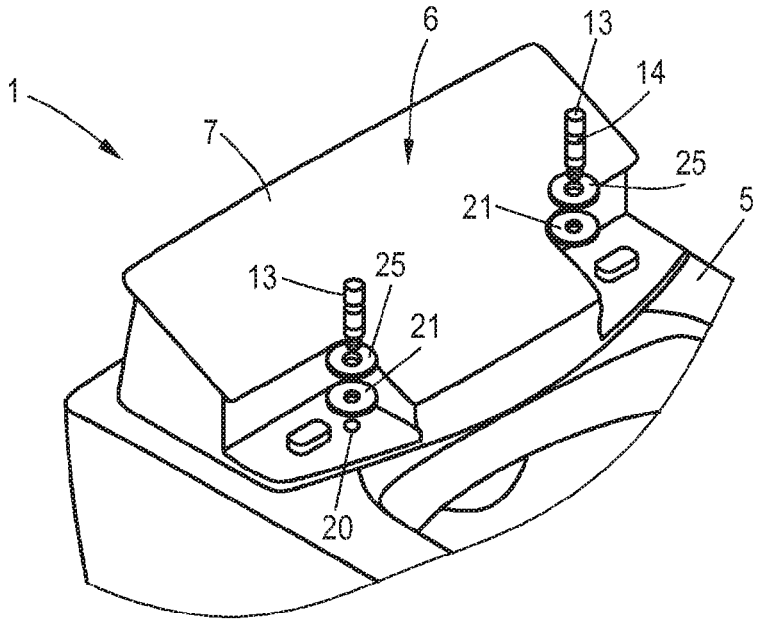
FIG. 6 shows a detailed view of part of the water closet according to the invention of FIG. 1 during the installation of the housing of the douche device of FIG. 4.

FIG. 6 shows a perspective view of part of the water closet 1 of FIG. 1, in which the douche device 6, i.e., the housing 7 of the douche device 6, is being installed on the toilet bowl 5, i.e., on the mounting plate 8. FIG. 6 shows the mounting step which follows the step illustrated in FIG. 5. After the housing 7 has been pushed onto the projections 15 on the mounting plate 8, the housing 7 is still not completely mounted on the toilet bowl 5, however, because the housing can be detached again at any time by pushing it backwards, for when that is done, the projections 15 are pulled out of the complementary recesses 19, and the housing 7 can be lifted off the toilet bowl 5.

To complete the mounting of the housing 7 on the toilet bowl 5, therefore, the fastening elements 13 are screwed into the openings 12 provided for them in the mounting plate 8. The openings 12 are not visible here, because they are covered by the housing 7, which completely covers the mounting plate 8. The openings 20 in the housing 7, however, which are coaxial to the openings 12, can be easily seen. The fastening means 13 are guided through the openings 20 and then screwed into the openings 12 in the mounting plate 8. It is shown here that in each case a washer 21 is provided for each of the fastening elements 13, which improves the ability to tighten the fastening element 13 or fastening elements 13 against the housing 7. The washers 21 serve as support spacers for the fastening elements 13. For this purpose, the inside diameter of the washers 21 is smaller than that of the section of the fastening elements 13 which adjoins the external thread 24. In addition to the washers 21, washers 25 are also shown. The diameter of the hole in the washers 25 is larger than that of the washers 21. The washers 25 serve as damping stops for the connecting means 18 when the toilet seat set 2 is set down onto the fastening elements 13.

Figure 7:
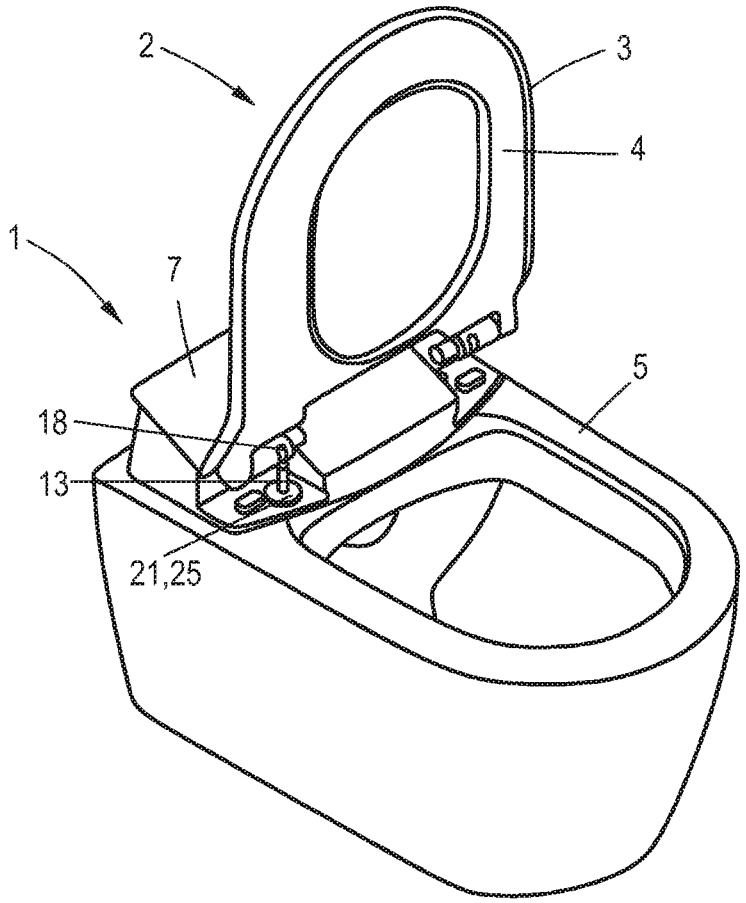
FIG. 7 shows the water closet according to the invention of FIG. 1 during the installation of the toilet seat set.

FIG. 7 shows the water closet 1 of FIG. 1 in the mounting step following the one shown in FIG. 6. Here the housing 7 of the douche device 6 is held in place on the toilet bowl 5, i.e., on the mounting plate 8, which is arranged underneath the housing 7, by means of the fastening elements 13. In the mounting step shown in FIG. 7, the toilet seat set 2 is attached to the fastening elements 13 and thus to the toilet bowl 5 by way of the mounting plate 8. To achieve this, the fastening elements 13 are introduced into the connecting means 18 of the toilet seat set 2; that is, the toilet seat set 2 with its connecting means 18 is set down from above onto the fastening elements 13, wherein, upon introduction of the fastening elements 13 into the connecting means 18, a latching connection is produced as a result of the internal structure of the connecting means 18. In the interior of each of the connecting elements 18, a projection is provided, which engages in the recess 14 in the corresponding fastening element 13.

Figure 8:
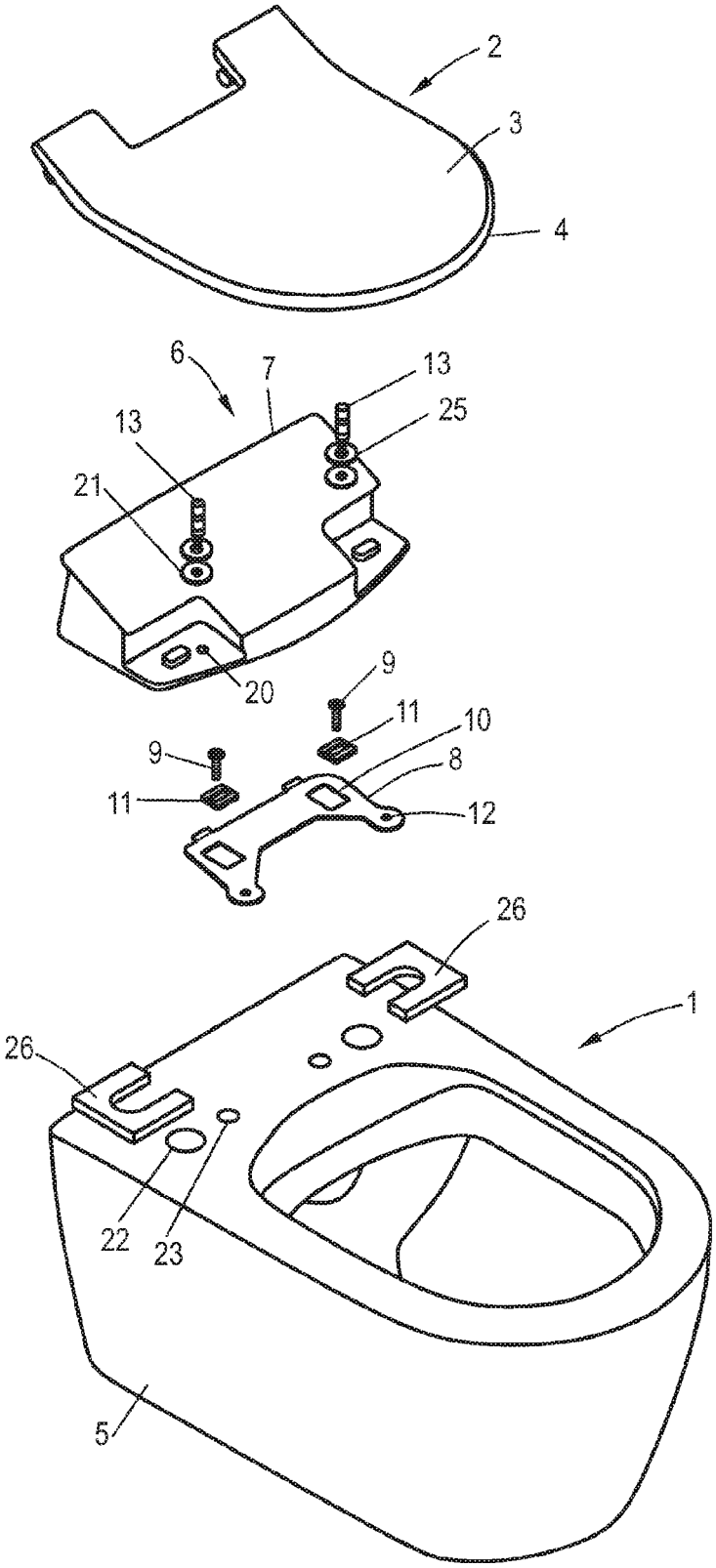
FIG. 8 shows an exploded view of the water closet according to the invention of FIG. 1.

Upon completion of the mounting step shown in FIG. 7, the water closet 1 is in the state shown in FIG. 1. FIG. 8 shows an exploded view of the water closet 1 of FIG. 1, wherein, for the sake of clarity, the line connectors 16, 17 are not shown.

While specific embodiments of the invention have been shown and described in detail to illustrate the inventive principles, it will be understood that the invention may be embodied otherwise without departing from such principles.

We claim:

1. A water closet comprising:

a toilet seat set with a lid element and a seat element, a toilet bowl, a douche device with a housing, a mounting plate detachably mounted on the toilet bowl, and means for fastening the housing of the douche device and the toilet seat set to the mounting plate, the means for fastening comprising either at least one fastening element, wherein the housing of the douche device and the toilet seat set are fastened to the mounting plate by the at least one fastening element and the toilet seat set is fastened to the at least one fastening element, or at least one first fastening element and at least one second fastening element, wherein the housing of the douche device is fastened to the mounting plate by the first fastening element and the toilet seat set is fastened to the mounting plate by the second fastening element.

2. The water closet according to claim 1, wherein the means for fastening comprises two of said at least one fastening element or two of the at least one first fastening element and two of the at least one second fastening element.

3. The water closet according to claim 1, wherein the at least one fastening element or the at least one first fastening element and the at least one second fastening element include an external thread at one end, which is screwed into at least one internally threaded opening in the mounting plate.

4. The water closet according to claim 1, wherein the toilet seat set includes at least one connecting element, by which the toilet seat set is fastened by a latching, clamping, or snap-in connection to the at least one fastening element or the at least one second fastening element.

5. The water closet according to claim 1, wherein the at least one fastening element or the at least one second fastening element includes a recess in its cross section at a free end, and the toilet seat set includes at least one connecting element complementary to the recess in the cross section.

6. The water closet according to claim 1, wherein the mounting plate includes at least one mounting opening to accept a mounting screw for fastening the mounting plate to the toilet bowl.

7. The water closet according to claim 1, wherein, to mount the toilet seat set and/or the housing of the douche device, at least one washer is provided.

8. The water closet according to claim 1, wherein the mounting plate includes at least one projection and the housing of the douche device includes at least one complementary recess or vice versa, and in that, in the installed state of the housing, the projection engages in the recess.

9. The water closet according to claim 1, wherein the housing of the douche device includes an electrical line connector and water line connector on the bottom.

10. The water closet according to claim 1, wherein the toilet bowl includes an opening for an electrical line connector and opening for a water line connector.

11. The water closet according to claim 1, wherein the means for fastening comprises the at least one fastening element.

12. The water closet according to claim 11, wherein the toilet seat set can be unfastened from the at least one fastening element without unfastening the housing of the douche device from the mounting plate.

13. The water closet according to claim 11, wherein the toilet seat set is fastened to the at least one fastening element by a latching, clamping, or snap-in connection.

14. The water closet according to claim 11, wherein the at least one fastening element includes a recess in its cross section at a free end, and the toilet seat set includes at least one connecting element complementary to the recess.

15. The water closet according to claim 11, wherein the mounting plate further includes at least one projection and the housing of the douche device includes at least one complementary recess or vice versa, and in that the projection engages in the recess.

* * * * *